US010920797B2

(12) United States Patent
Miyamoto et al.

(10) Patent No.: US 10,920,797 B2
(45) Date of Patent: Feb. 16, 2021

(54) HYDRAULIC CIRCUIT

(71) Applicant: Komatsu Ltd., Tokyo (JP)

(72) Inventors: Yuusuke Miyamoto, Tokyo (JP); Yuichi Hishinuma, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 16/634,891

(22) PCT Filed: Oct. 19, 2018

(86) PCT No.: PCT/JP2018/038995

§ 371 (c)(1),
(2) Date: Jan. 29, 2020

(87) PCT Pub. No.: WO2019/138636

PCT Pub. Date: Jul. 18, 2019

(65) Prior Publication Data

US 2020/0232482 A1 Jul. 23, 2020

(30) Foreign Application Priority Data

Jan. 11, 2018 (JP) ..... JP2018-002884

(51) Int. Cl.
*F15B 11/024* (2006.01)
*E02F 9/22* (2006.01)
(Continued)

(52) U.S. Cl.
CPC ..... *F15B 11/024* (2013.01); *E02F 9/2203* (2013.01); *F15B 11/04* (2013.01); *F15B 11/08* (2013.01); *F15B 21/14* (2013.01)

(58) Field of Classification Search
CPC ..... F15B 11/024; F15B 11/08; F15B 21/14; E02F 9/2203
See application file for complete search history.

(56) References Cited

U.S. PATENT DOCUMENTS 5,218,897 A * 6/1993 Shirai ..... F15B 11/024 91/436
5,479,778 A * 1/1996 Toyooka ..... F15B 11/024 60/431

(Continued)

FOREIGN PATENT DOCUMENTS

JP 2013-137062 A 7/2013
JP 2017-89865 A 5/2017

OTHER PUBLICATIONS

International Search Report dated Jan. 15, 2019, issued for PCT/JP2018/038995.

*Primary Examiner* — Michael Leslie
(74) *Attorney, Agent, or Firm* — Locke Lord LLP

(57) ABSTRACT

A hydraulic circuit includes: a direction switching valve, which is in a state where a bottom oil path is connected to a first tank oil path and where a bypass oil path is connected to a second tank oil path when a pump oil path is connected to a rod oil path and when the rod oil path is connected to the bypass oil path when the pump oil path is connected to the bottom oil path, and a pilot operation control valve which allows flows of oil in both directions between the direction switching valve and the bottom oil path when the pump oil path is connected to the rod oil path and allows only a flow of oil from the direction switching valve to the bottom oil path when the pump oil path is connected to the bottom oil path by the direction switching valve.

7 Claims, 11 Drawing Sheets

(51) Int. Cl.

| | |
|---|---|
| ***F15B 11/08*** | (2006.01) |
| ***F15B 21/14*** | (2006.01) |
| ***F15B 11/04*** | (2006.01) |

(56) References Cited

U.S. PATENT DOCUMENTS

| | | | | |
|---|---|---|---|---|
| 5,862,831 | A * | 1/1999 | Chung | F15B 11/024 137/596.2 |
| 9,175,698 | B2 | 11/2015 | Oguma et al. | |
| 9,797,419 | B2 * | 10/2017 | Rantanen | F15B 21/14 |
| 10,526,768 | B2 * | 1/2020 | Hijikata | F15B 11/024 |

* cited by examiner

HYDRAULIC CIRCUIT

FIELD

The present invention relates to a hydraulic circuit configured to operate a hydraulic cylinder.

BACKGROUND

To a single-rod double-acting hydraulic cylinder for use in operating an arm of a construction machine, a hydraulic circuit including a so-called quick return circuit and regeneration circuit is applied. For example, in a hydraulic circuit described in Patent Literature 1, an external tank oil path is connected to a bottom oil path connected to a bottom chamber to form a quick return circuit. In the hydraulic circuit including the quick return circuit, oil exhausted from the bottom chamber is partially exhausted directly to a tank to enable a pressure loss generated when the rod of the hydraulic cylinder is contracted to be reduced. Further, in the hydraulic circuit in Patent Literature 1, a bypass oil path is provided between a rod oil path connected to a rod chamber of the hydraulic cylinder and the bottom oil path to form a regeneration circuit. In the hydraulic circuit including the regeneration circuit, oil exhausted from the bottom chamber of the hydraulic cylinder is supplied to the rod chamber to prevent shortage of oil in the rod chamber from occurring.

CITATION LIST

Patent Literature

Patent Literature 1: Japanese Laid-open Patent Publication No. 2013-137062

SUMMARY

Technical Problem

Meanwhile, in the aforementioned hydraulic circuit, to prevent oil discharged from the hydraulic pump from returning directly to the tank through the external tank oil path, a control valve controlling a flow of oil is required to be provided in the quick return circuit. Further, to prevent oil to be supplied to the bottom chamber from being supplied to the rod chamber through the bypass oil path, a control valve controlling a flow of oil is required to be provided in the regeneration circuit as well. Consequently, to achieve the hydraulic circuit in Patent Literature 1, a space to provide the two control valves is required, which causes a size increase of the hydraulic apparatus to which the hydraulic circuit is applied and a problem of a cost increase due to an increase in the number of parts.

In consideration of the above circumstances, an object of the present invention is to provide a hydraulic circuit enabling a quick return circuit and a regeneration circuit to be provided without causing a size increase and a cost increase of a hydraulic apparatus to which the hydraulic circuit is applied.

Solution to Problem

To attain the above object, a hydraulic circuit according to the present invention includes: a direction switching valve, disposed between a hydraulic pump and a hydraulic cylinder, configured to switch a connection state of the hydraulic pump with respect to a bottom chamber and a rod chamber of the hydraulic cylinder to expand and contract the hydraulic cylinder; a pump oil path connecting between a discharge port of the hydraulic pump and the direction switching valve; a bottom oil path connecting between the bottom chamber of the hydraulic cylinder and the direction switching valve; a rod oil path connecting between the rod chamber of the hydraulic cylinder and the direction switching valve; two tank oil paths each connecting between a tank and the direction switching valve; and a bypass oil path connecting between the bottom oil path and the direction switching valve and including a pilot operation control valve in a middle of the bypass oil path. Further, the direction switching valve is in a state in which the bottom oil path is connected to a first one of the two tank oil paths and in which the bypass oil path is connected to a second one of the two tank oil paths in a case in which the pump oil path is connected to the rod oil path and is in a state in which the rod oil path is connected to the bypass oil path in a case in which the pump oil path is connected to the bottom oil path, and the pilot operation control valve is in a state of allowing flows of oil in both directions between the direction switching valve and the bottom oil path in the bottom oil path in a case in which the pump oil path is connected to the rod oil path by the direction switching valve and is in a state of allowing only a flow of oil from the direction switching valve to the bottom oil path in the bottom oil path in a case in which the pump oil path is connected to the bottom oil path by the direction switching valve.

Advantageous Effects of Invention

According to the present invention, a bypass oil path is selectively connected to a rod oil path and a tank oil path by means of a direction switching valve. Accordingly, by providing a single pilot operation control valve in the bypass oil path, the bypass oil path can selectively function as a quick return circuit and a regeneration circuit. Consequently, it is not necessary to provide two control valves in a hydraulic circuit, it is possible to prevent a size increase of a hydraulic apparatus to which the hydraulic circuit is applied, and it is possible to suppress a cost increase along with an increase in the number of parts.

DESCRIPTION OF EMBODIMENTS

Hereinafter, preferred embodiments of a hydraulic circuit according to the present invention will be described in detail with reference to the accompanying drawings.

First Embodiment

Figure 1:
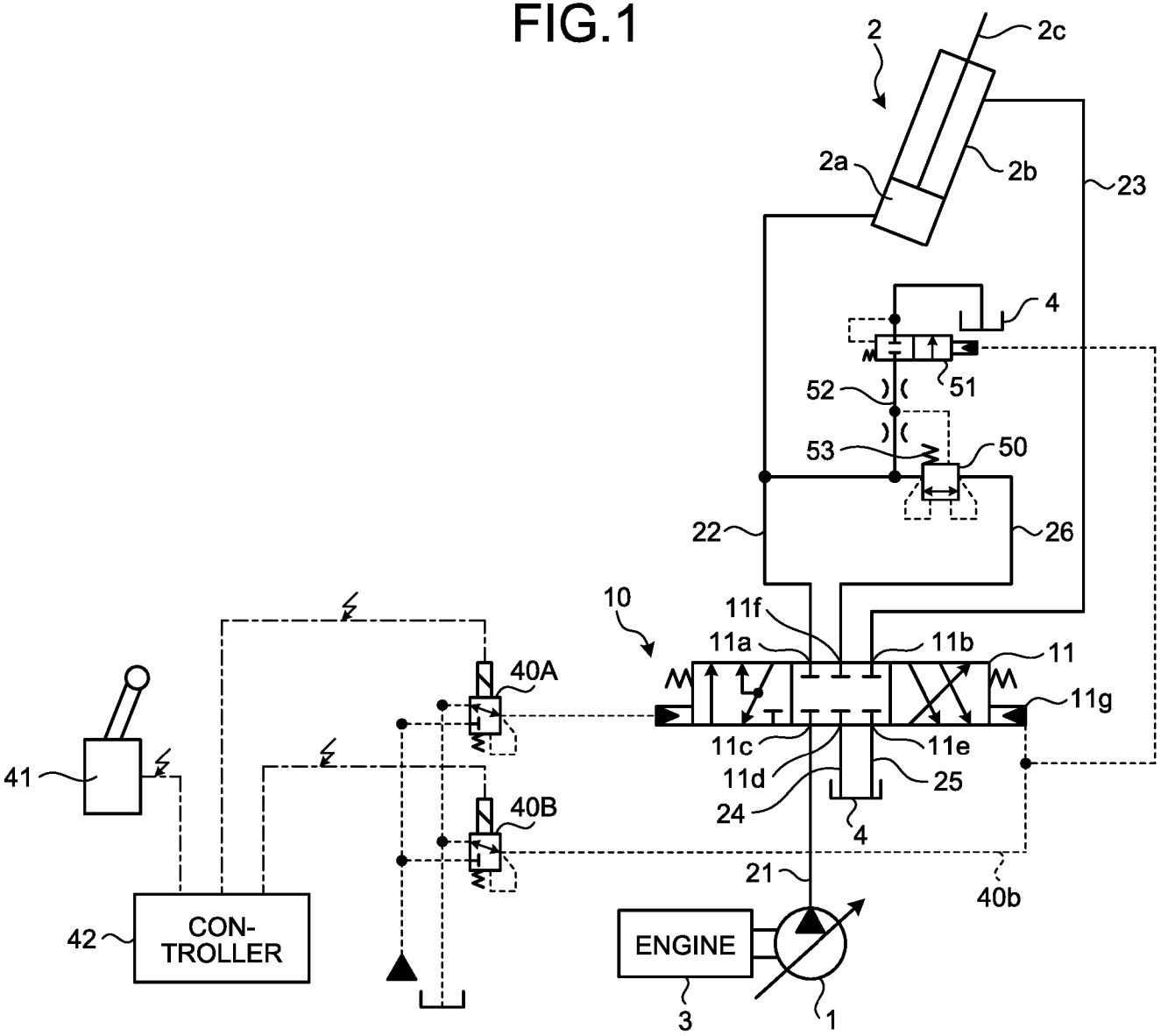
FIG. 1 illustrates a state in which a spool of a direction switching valve is arranged at a neutral position in a hydraulic circuit according to a first embodiment of the present invention.
Figure 2:
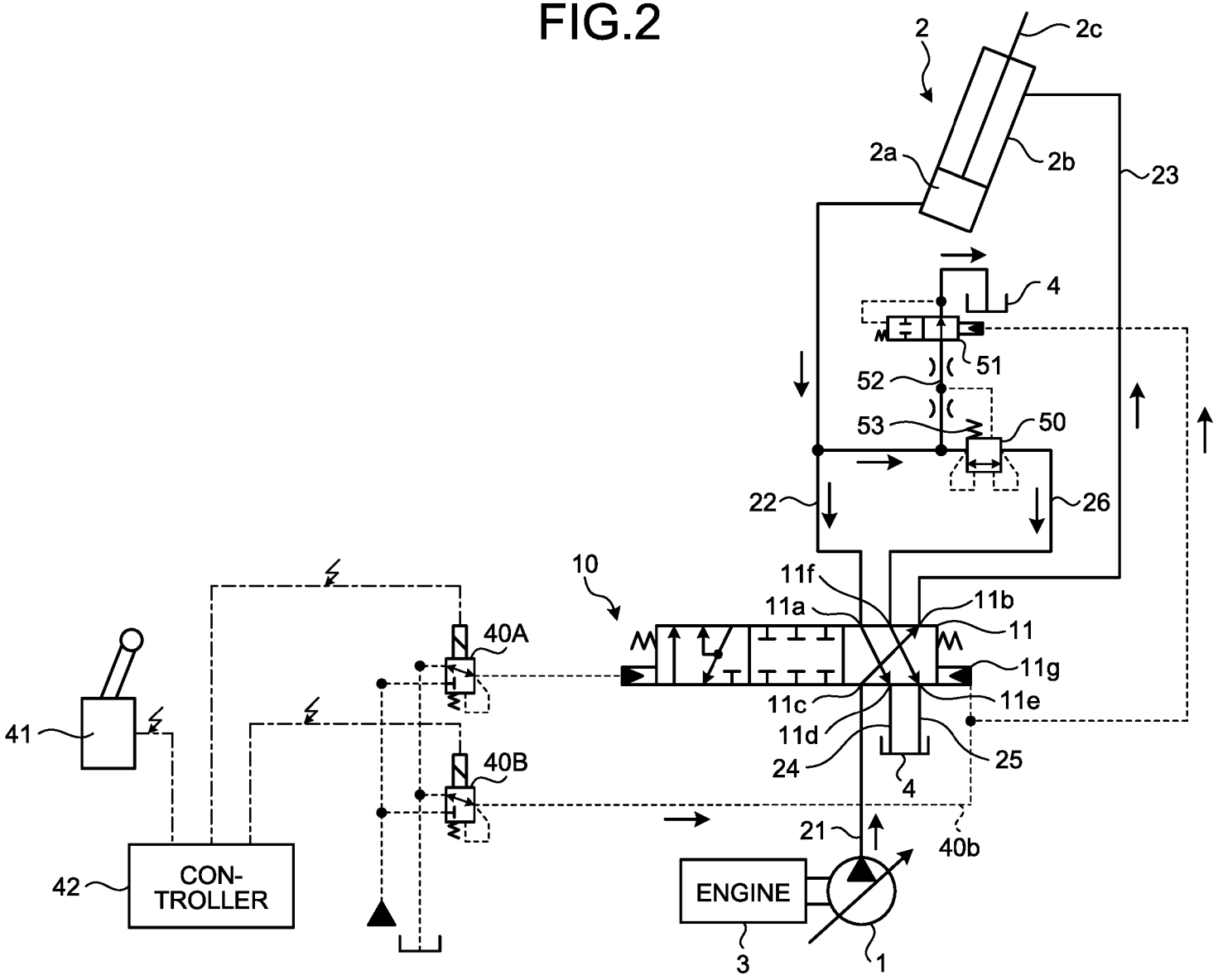
FIG. 2 illustrates a state in which the spool of the direction switching valve is arranged at a contraction position in the hydraulic circuit illustrated in FIG. 1.
Figure 3:
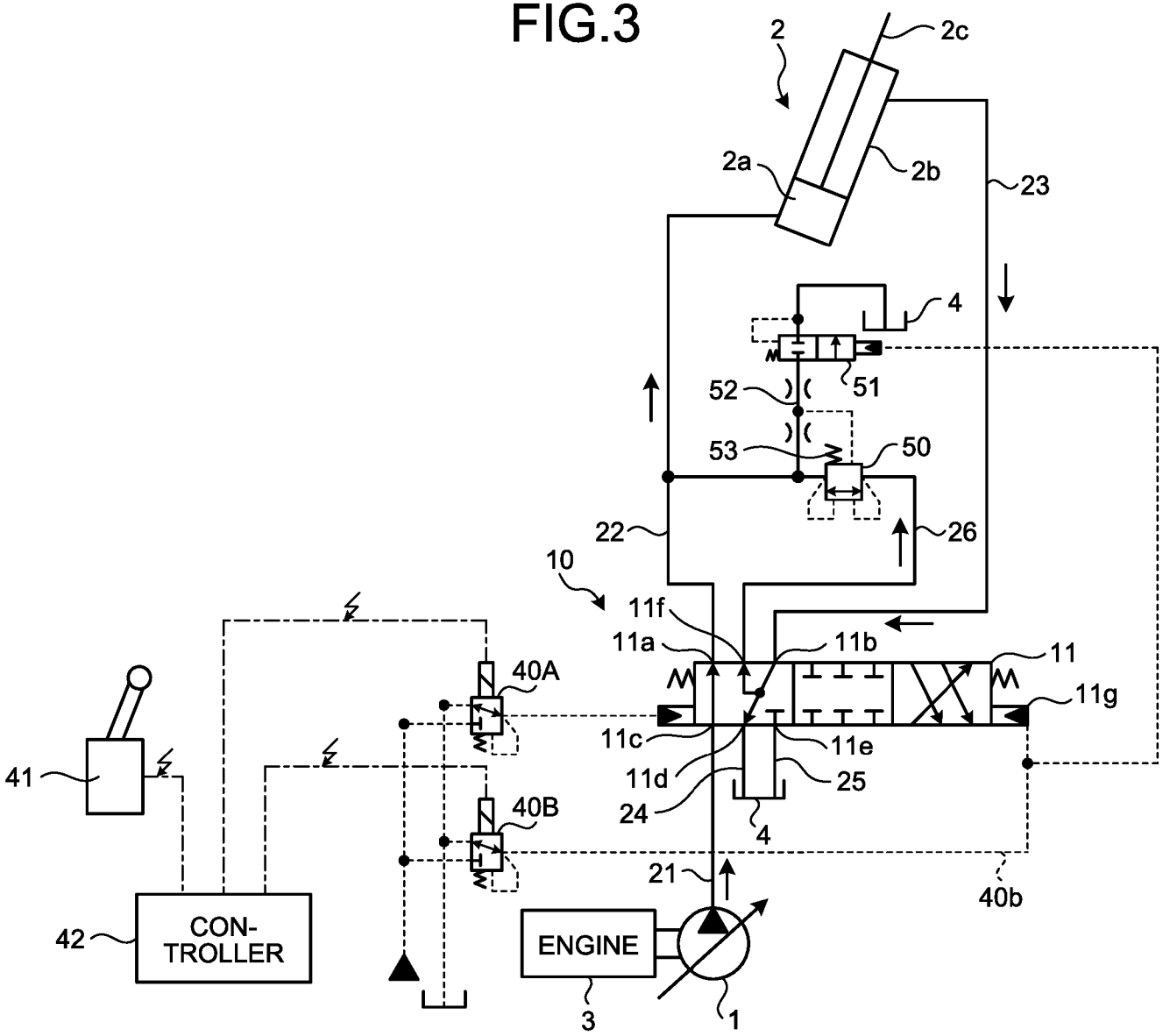
FIG. 3 illustrates a state in which the spool of the direction switching valve is arranged at an expansion position in the hydraulic circuit illustrated in FIG. 1.
Figure 4:
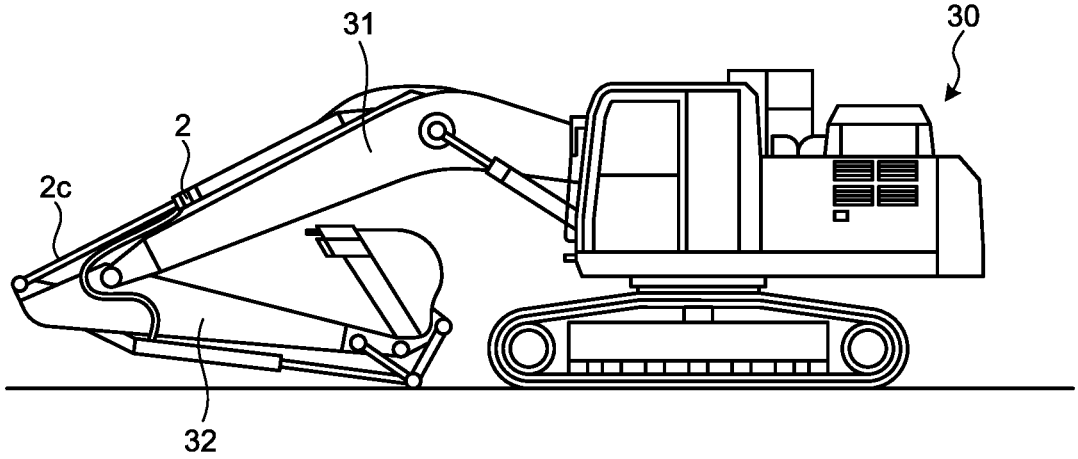
FIG. 4 is a side view of a construction machine including a hydraulic cylinder controlled by the hydraulic circuit illustrated in FIG. 1.

FIGS. 1 to 3 illustrate a hydraulic circuit according to a first embodiment of the present invention. The hydraulic circuit herein illustrated is configured to operate a hydraulic cylinder 2 by means of oil supplied from a hydraulic pump 1 and includes a direction switching valve 10. The hydraulic pump 1 is a variable displacement hydraulic pump driven by an engine 3. To a discharge port of the hydraulic pump 1, a pump oil path 21 is connected. The hydraulic cylinder 2 is a single-rod double-acting hydraulic cylinder for use in operating an arm 32 with respect to a boom 31 of a construction machine 30 as illustrated in FIG. 4. In the hydraulic cylinder 2, a bottom oil path 22 is connected to a bottom chamber 2*a*, and a rod oil path 23 is connected to a rod chamber 2*b*, as illustrated in FIG. 1.

The direction switching valve 10 is of a closed center type operated by a pilot pressure output from operation valves 40A and 40B as illustrated in FIGS. 1 to 3. The operation valves 40A and 40B are operated by a control signal from a controller 42 along with an operation of an operation lever (electric lever) 41. As is apparent from the figure, the direction switching valve 10 includes a single spool 11. The direction switching valve 10 is configured to selectively switch connection states of a pump port 11*c* and two drain ports 11*d* and 11*e* to two input/output ports 11*a* and 11*b* and to selectively switch connection states of the input/output port 11*b* and the drain port 11*e* to one bypass port 11*f*.

More specifically, in the direction switching valve 10, in a case in which the spool 11 moves to the left side from a neutral position illustrated in FIG. 1 and is arranged at a contraction position illustrated in FIG. 2, one input/output port (hereinafter referred to as a first input/output port 11*a*) is connected to one drain port (hereinafter referred to as a first drain port 11*d*), and the other input/output port (hereinafter referred to as a second input/output port 11*b*) is connected to the pump port 11*c*. Further, at this contraction position, the bypass port 11*f* is kept connected to the other drain port (hereinafter referred to as a second drain port 11*e*). In the direction switching valve 10, in a case in which the spool 11 moves to the right side from the neutral position and is arranged at an expansion position illustrated in FIG. 3, the first input/output port 11*a* is connected to the pump port 11*c*, and the second input/output port 11*b* is branched and connected to the first drain port 11*d* and the bypass port 11*f*. Meanwhile, at the expansion position, the second drain port 11*e* is in a closed state.

As illustrated in FIGS. 1 to 3, in the direction switching valve 10, the bottom oil path 22 is connected to the first input/output port 11*a*, and the rod oil path 23 is connected to the second input/output port 11*b*. The pump oil path 21 is connected to the pump port 11*c*, and two tank oil paths 24 and 25 connected to a tank 4 are respectively connected to the two drain ports 11*d* and 11*e*.

Further, a bypass oil path 26 is connected to the bypass port 11*f* of the direction switching valve 10. The bypass oil path 26 is branched from the bottom oil path 22 and includes a pilot operation control valve in the middle thereof. In the first embodiment, a pilot operation check valve 50 is applied as the pilot operation control valve. The pilot operation check valve 50 performs a switching operation by means of the pilot pressure output from the operation valve 40B to control a flow of oil in the bypass oil path 26.

Specifically, in a case in which the pilot pressure from the operation valve 40B does not act, oil pressure of the bottom oil path 22 acts as back pressure through a back pressure oil path 52. The pilot operation check valve 50 is thus in a state of allowing only a flow of oil from the bypass port 11*f* of the direction switching valve 10 to the bottom oil path 22 in the bypass oil path 26. Conversely, in a case in which the pilot pressure acts from the operation valve 40B, in the pilot operation check valve 50, since a switching valve element 51 is opened to cause oil in the back pressure oil path 52 is drained into the tank 4 as illustrated in FIG. 2, the back pressure from the back pressure oil path 52 is zero. As a result, the pilot operation check valve 50 is in a state of allowing flows of oil in both directions between the bottom oil path 22 and the bypass port 11*f* of the direction switching valve 10 in the bypass oil path 26. In other words, in a case in which the pilot pressure acts from the operation valve 40B, the pilot operation check valve 50 opens to have an opening area corresponding to a balance between the pressure of the bypass oil path 26 and the pressing force of a built-in spring 53 and allows a flow of oil from the bypass port 11*f* to the bottom oil path 22 and a flow of oil from the bottom oil path 22 to the bypass port 11*f*.

In the first embodiment, a pilot oil path 40*b* from the aforementioned operation valve 40B is configured to cause the pilot pressure to act on a pressure chamber 11*g* provided on the right side of the spool 11 in the direction switching valve 10. That is, in the aforementioned hydraulic circuit, in a case in which the spool 11 of the direction switching valve 10 is arranged at the contraction position, the pilot pressure acts on the switching valve element 51, and oil is allowed to flow in both directions in the bypass oil path 26.

In the hydraulic circuit configured as above, for example, when the operation lever 41 is operated in the state illustrated in FIG. 1 to contract the hydraulic cylinder 2, the pilot pressure is output from the operation valve 40B to the direction switching valve 10 by a control signal from the controller 42, and the spool 11 moves to the left side to reach the contraction position, as illustrated in FIG. 2. Accordingly, oil discharged from the hydraulic pump 1 is supplied via the pump oil path 21 and the rod oil path 23 to the rod chamber 2*b* of the hydraulic cylinder 2 and is exhausted from the bottom chamber 2*a* of the hydraulic cylinder 2 via the bottom oil path 22 and one tank oil path (hereinafter simplified as the first tank oil path 24) to the tank 4. This causes the hydraulic cylinder 2 to contract.

Here, in the single-rod double-acting hydraulic cylinder 2, since the bottom chamber 2*a* provided therein with no rod 2*c* and the rod chamber 2*b* provided therein with the rod 2*c* are different in volume, and the amount of oil exhausted from the bottom chamber 2*a* is greater than the amount of oil supplied to the rod chamber 2*b*, the pressure of the bottom oil path 22 increases, which can cause a pressure loss.

However, according to the above hydraulic circuit, the bypass oil path 26 is provided between the bottom oil path 22 and the bypass port 11*f* of the direction switching valve 10, and the two tank oil paths 24 and 25 are connected to the direction switching valve 10. As described above, in a case in which the spool 11 of the direction switching valve 10 is arranged at the contraction position, and in which the bypass port 11*f* is connected to the second drain port 11*e*, the pilot operation check valve 50 is switched so as to allow a flow of oil from the bypass port 11*f* to the bottom oil path 22 and a flow of oil from the bottom oil path 22 to the bypass port 11*f* in the bypass oil path 26. Accordingly, in a case in which a large amount of oil is exhausted from the bottom chamber 2*a* to cause pressure in the bypass oil path 26 to increase, a flow of oil from the bottom oil path 22 to the bypass port 11*f* is generated in the bypass oil path 26 (quick return circuit). That is, oil exhausted from the bottom chamber 2*a* is exhausted via the first tank oil path 24 connected to the first drain port 11*d* of the direction switching valve 10 to the tank 4 and passes the bypass oil path 26, and is exhausted via the other tank oil path (hereinafter referred to simply as the second tank oil path 25) connected to the second drain port 11*e* of the direction switching valve 10 to the tank 4. Accordingly, when the hydraulic cylinder 2 is contracted, the pressure of the bottom oil path 22 decreases, and it is possible to prevent a pressure loss from being generated.

Moreover, in a case in which the pressure of the bottom chamber 2*a* decreases even during the above period, the opening area of the pilot operation check valve 50 decreases to correspond to the decreased pressure of the bottom oil path 22, and a flow of oil via the bypass oil path 26 is restricted. Consequently, this hydraulic circuit may not cause a situation in which cavitation occurs in the bottom chamber 2*a* when the hydraulic cylinder 2 is contracted.

Conversely, in the hydraulic circuit, when the operation lever 41 is operated in the state illustrated in FIG. 1 to expand the hydraulic cylinder 2, the pilot pressure is output from the operation valve 40A to the direction switching valve 10 by a control signal from the controller 42, and the spool 11 moves to the right side to reach the expansion position, as illustrated in FIG. 3. Accordingly, oil discharged from the hydraulic pump 1 is supplied via the pump oil path 21 and the bottom oil path 22 to the bottom chamber 2*a* of the hydraulic cylinder 2 and is exhausted from the rod chamber 2*b* of the hydraulic cylinder 2 via the rod oil path 23 and the second tank oil path 25 to the tank 4. This causes the hydraulic cylinder 2 to expand.

During this period, since the pilot pressure is not output from the operation valve 40B, the pilot operation check valve 50 provided in the bypass oil path 26 is in a state of allowing only a flow of oil from the bypass port 11*f* to the bottom oil path 22 in the bypass oil path 26.

That is, in the bypass oil path 26, in a case in which the pressure between the bottom oil path 22 and the pilot operation check valve 50 is higher than the pressure between the bypass port 11*f* and the pilot operation check valve 50, the pilot pressure acting on the pilot operation check valve 50 is equal to the back pressure acting on the pilot operation check valve 50 via the back pressure oil path 52. Accordingly, the pilot operation check valve 50 is kept closed by the built-in spring 53, and oil will not flow from the bottom oil path 22 toward the bypass port 11*f*.

On the other hand, in the bypass oil path 26, in a case in which the pressure between the bottom oil path 22 and the pilot operation check valve 50 is lower than the pressure between the bypass port 11*f* and the pilot operation check valve 50, the pilot pressure acting on the pilot operation check valve 50 is higher than the back pressure acting via the back pressure oil path 52. Thus, the pilot operation check valve 50 opens, and a flow of oil from the bypass port 11*f* toward the bottom oil path 22 is allowed.

As a result of the above, when the hydraulic cylinder 2 is expanded, oil supplied from the pump oil path 21 to the bottom oil path 22 does not pass the bypass oil path 26 but is reliably supplied from the bottom oil path 22 to the bottom chamber 2*a* of the hydraulic cylinder 2. Moreover, in a case in which the pressure of the bottom oil path 22 gets lower than that of the rod oil path 23, oil exhausted from the rod chamber 2*b* of the hydraulic cylinder 2 is partially supplied via the bypass oil path 26 to the bottom oil path 22. This can prevent a situation in which oil in the bottom chamber 2*a* lacks when the hydraulic cylinder 2 is expanded from being generated, and the arm 32 of the construction machine 30 can be operated quickly (regeneration circuit).

As described above, in this hydraulic circuit, when the spool 11 of the direction switching valve 10 is operated, the bypass oil path 26 is selectively connected to the rod oil path 23 and the second tank oil path 25. Thus, by providing the single pilot operation check valve 50 in the bypass oil path 26, the bypass oil path 26 can selectively function as a quick return circuit and a regeneration circuit. Consequently, it is not necessary to provide a control valve dedicated for the quick return circuit and a control valve dedicated for the regeneration circuit in the hydraulic circuit, it is possible to prevent a size increase of a hydraulic apparatus to which the hydraulic circuit is applied, and it is possible to restrict a cost increase along with an increase in the number of parts.

First Modification Example

Figure 5:
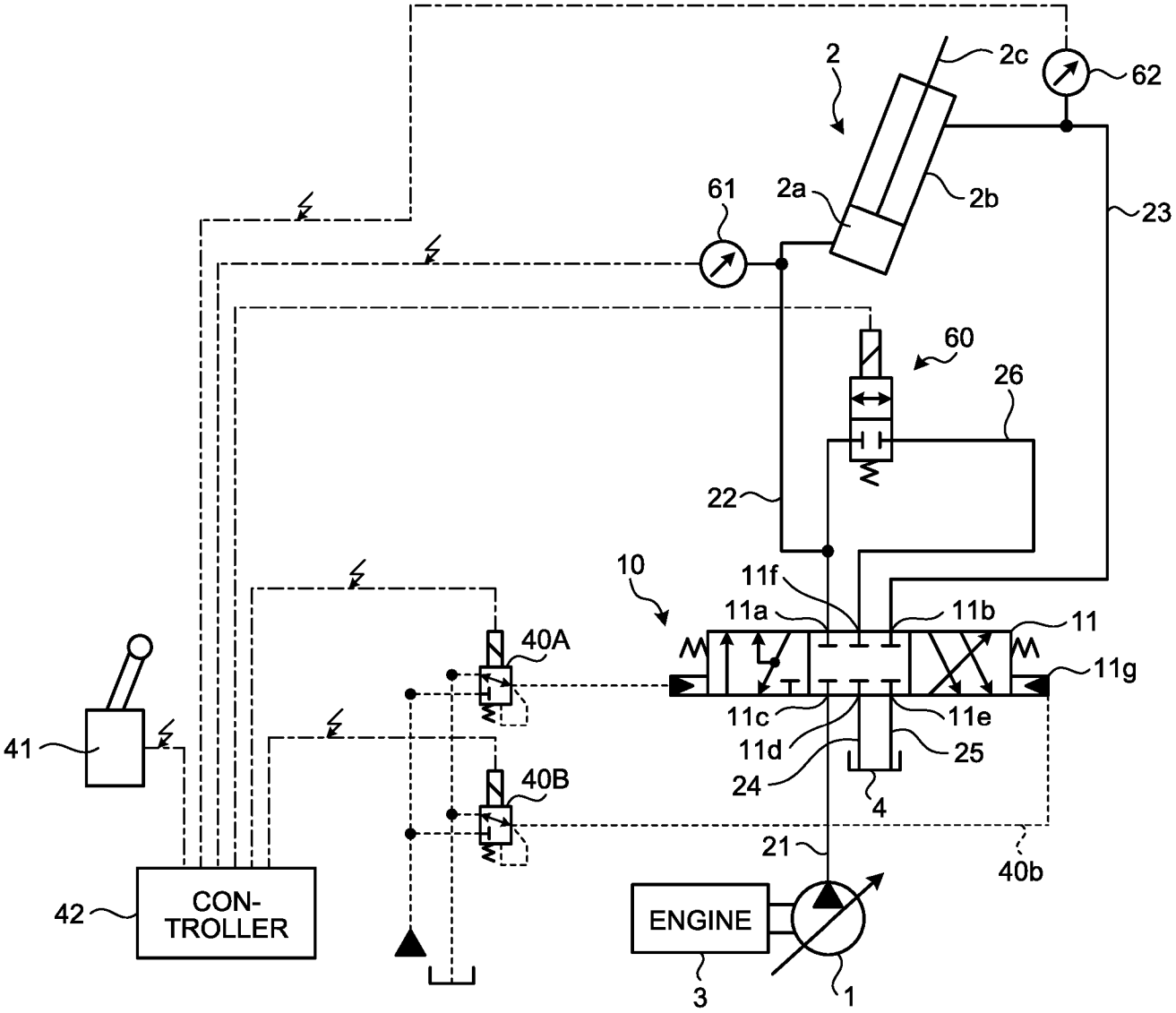
FIG. 5 illustrates a first modification example of the hydraulic circuit illustrated in FIG. 1.

Meanwhile, in the aforementioned first embodiment, although the hydraulic circuit using the pilot operation check valve 50 as a pilot operation control valve is illustrated, a pilot operation switching valve 60 switching to a connection position and a disconnection position can be used as the pilot operation control valve as in a first modification example illustrated in FIG. 5. In a case in which this pilot operation switching valve 60 is applied, pressure gauges 61 and 62 may be provided to the bottom oil path 22 and the rod oil path 23, respectively, and the detection results of the respective pressure gauges 61 and 62 may be output to the controller 42.

That is, in a case in which oil discharged from the hydraulic pump 1 is supplied via the pump oil path 21 and the rod oil path 23 to the rod chamber 2*b* of the hydraulic cylinder 2 to contract the hydraulic cylinder 2, a control signal is output from the controller 42 to open the pilot operation switching valve 60. As a result, oil exhausted from the bottom chamber 2*a* partially passes the bypass oil path 26 and is exhausted to the tank 4. Accordingly, when the hydraulic cylinder 2 is contracted, the pressure of the bottom oil path 22 decreases, and it is possible to prevent a pressure loss from being generated (quick return circuit). During this period, in a case in which the pressure of the bottom oil path 22 is lower than a predetermined threshold value, a control signal is preferably output from the controller 42 to decrease the opening area of the pilot operation switching valve 60 to prevent cavitation from occurring in the bottom chamber 2*a* of the hydraulic cylinder 2 in advance.

On the other hand, in a case in which oil discharged from the hydraulic pump 1 is supplied via the pump oil path 21 and the bottom oil path 22 to the bottom chamber 2*a* of the hydraulic cylinder 2 to expand the hydraulic cylinder 2, the pressure of the bottom oil path 22 and the pressure of the rod oil path 23 are compared in the controller 42. In a case in which the pressure of the bottom oil path 22 is lower than the pressure of the rod oil path 23, the controller 42 outputs a control signal to open the pilot operation switching valve 60. As a result, oil exhausted from the rod chamber 2*b* of the hydraulic cylinder 2 is partially supplied via the bypass oil path 26 to the bottom oil path 22. Accordingly, the bottom chamber 2*a* of the hydraulic cylinder 2 is supplied with oil supplied from the pump oil path 21 to the bottom oil path 22 in a state in which oil from the bypass oil path 26 is added, and the arm 32 of the construction machine 30 can be operated quickly (regeneration circuit).

Conversely, in a case in which the pressure of the bottom oil path 22 is higher than the pressure of the rod oil path 23, the controller 42 keeps the pilot operation switching valve 60 closed. Accordingly, in this hydraulic circuit, oil supplied from the hydraulic pump 1 via the pump oil path 21 to the bottom oil path 22 does not pass the bypass oil path 26 but is reliably supplied from the bottom oil path 22 to the bottom chamber 2*a* of the hydraulic cylinder 2.

Meanwhile, in the aforementioned first modification example, although the opening area of the pilot operation switching valve 60 is controlled when the hydraulic cylinder 2 is contracted based on the comparison result between the pressure of the bottom oil path 22 detected in the pressure gauge 61 and the pressure of the rod oil path 23 detected in the pressure gauge 62, the present invention is not limited to this. For example, moving speed of the rod 2*c* may be calculated from the displacement amount of the rod 2*c* detected by a stroke sensor (not illustrated) provided in the hydraulic cylinder 2, a target speed of the rod 2*c* may be calculated from the operation signal of the operation lever 41, and a control signal may be output so that the opening area of the pilot operation switching valve 60 may change in accordance with the difference between these speeds. Specifically, in a case in which the actual moving speed of the rod 2*c* is higher than the target speed of the rod 2*c*, a control signal may be output from the controller 42 so that the opening area of the pilot operation switching valve 60 may decrease as the difference between these speeds is greater.

Second Modification Example

Figure 6:
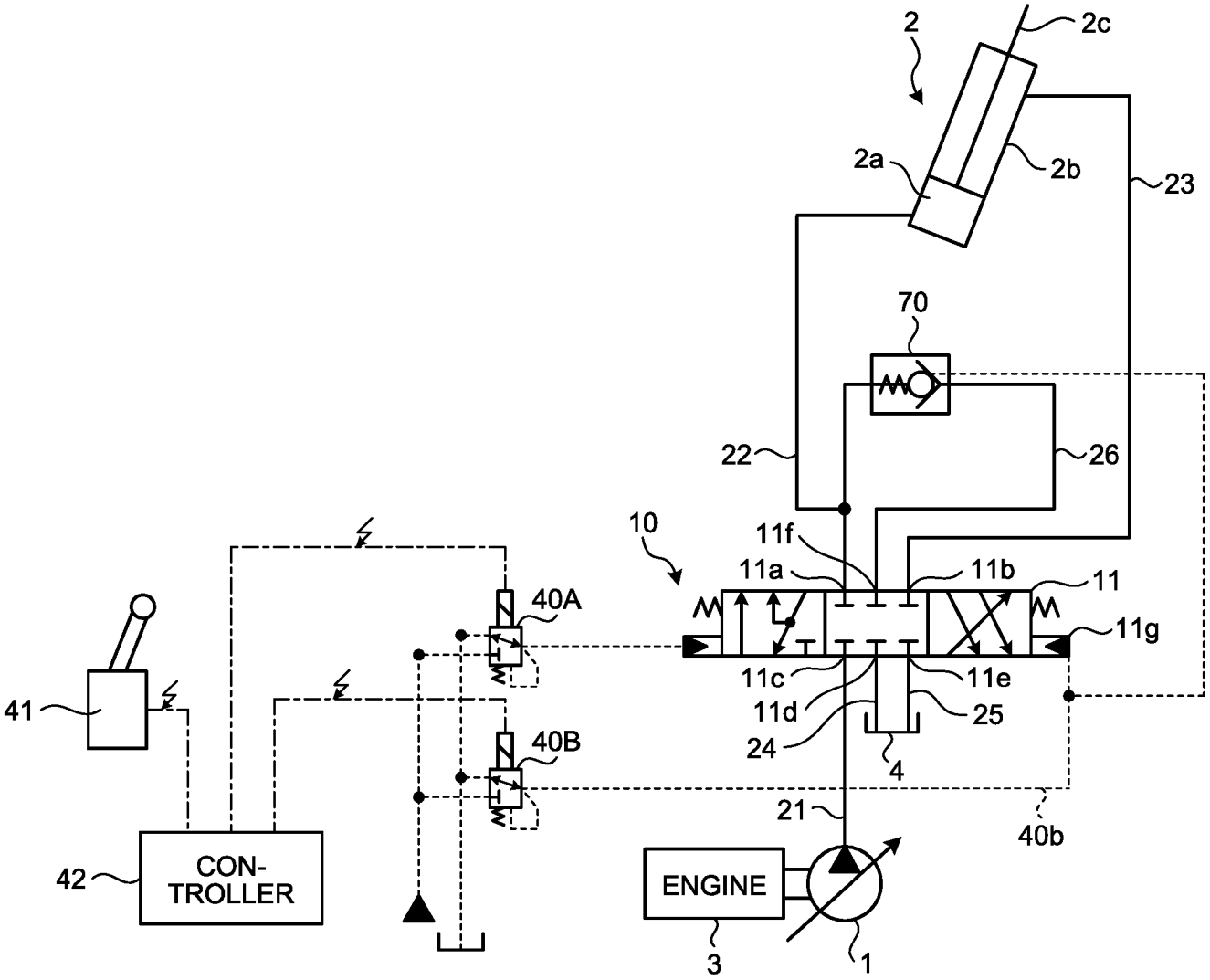
FIG. 6 illustrates a second modification example of the hydraulic circuit illustrated in FIG. 1.

Further, in the aforementioned first embodiment, although the pilot operation check valve 50, which is in an open state in a case in which the pressure on the upstream side is high, is applied, a pilot operation check valve 70, which allows a flow of oil from the bottom oil path 22 to the bypass port 11*f* only in a case in which a control signal is provided from the controller 42, may be applied as in a second modification example illustrated in FIG. 6.

That is, in the second modification example, in a case in which oil discharged from the hydraulic pump 1 is supplied via the pump oil path 21 and the rod oil path 23 to the rod chamber 2*b* of the hydraulic cylinder 2, a control signal is output from the controller 42 to the operation valve 40B, and pilot pressure acts on the pilot operation check valve 70. In a case in which the pilot pressure acts on the pilot operation check valve 70, a flow of oil from the bottom oil path 22 to the bypass port 11*f* of the direction switching valve 10 is allowed in the bypass oil path 26. Thus, oil exhausted from the bottom chamber 2*a* partially passes the bypass oil path 26 and is exhausted to the tank 4. Consequently, when the hydraulic cylinder 2 is contracted, the pressure of the bottom oil path 22 decreases, and it is possible to prevent a pressure loss from being generated (quick return circuit).

On the other hand, in a case in which oil discharged from the hydraulic pump 1 is supplied via the pump oil path 21 and the bottom oil path 22 to the bottom chamber 2*a* of the hydraulic cylinder 2, no control signal is output from the controller 42 to the operation valve 40B, and no pilot pressure acts on the pilot operation check valve 70. Hence, in this case, the pilot operation check valve 70 opens only in a case in which the pressure of the bottom oil path 22 is lower than the pressure between the bypass port 11*f* and the pilot operation check valve 70. As a result, oil exhausted from the rod chamber 2*b* of the hydraulic cylinder 2 is partially supplied via the bypass oil path 26 to the bottom oil path 22, a situation in which oil in the bottom chamber 2*a* lacks can be prevented, and the arm 32 of the construction machine 30 can be operated quickly (regeneration circuit). In a case in which the pressure of the bottom oil path 22 is higher than the pressure between the bypass port 11*f* and the pilot operation check valve 70, the pilot operation check valve 70 is kept closed. Thus, oil supplied from the hydraulic pump 1 via the pump oil path 21 to the bottom oil path 22 does not pass the bypass oil path 26 but is reliably supplied to the bottom chamber 2*a* of the hydraulic cylinder 2.

Second Embodiment

Figure 7:
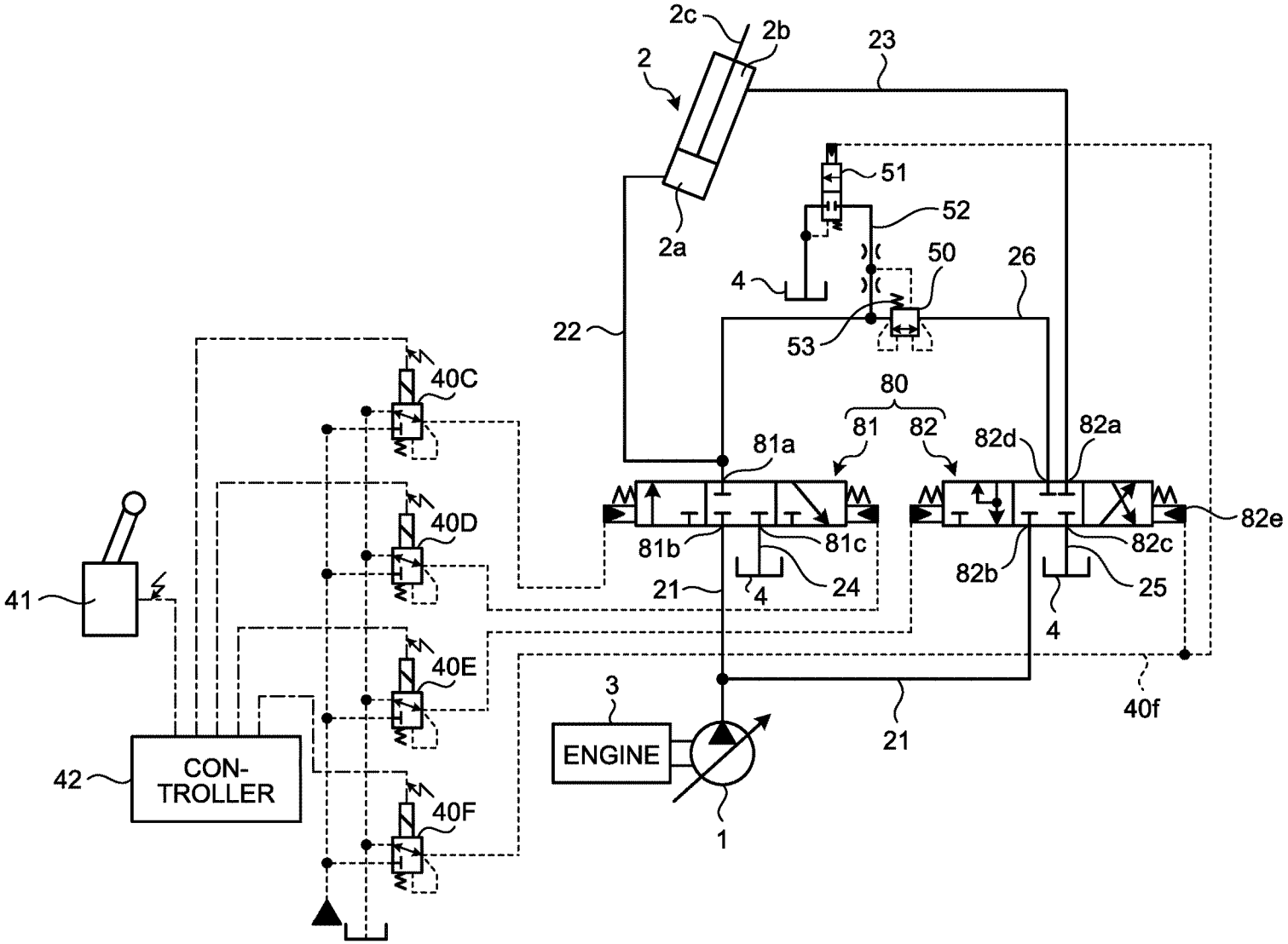
FIG. 7 illustrates a state in which each of two spools is arranged at a neutral position in a hydraulic circuit according to a second embodiment of the present invention.
Figure 8:
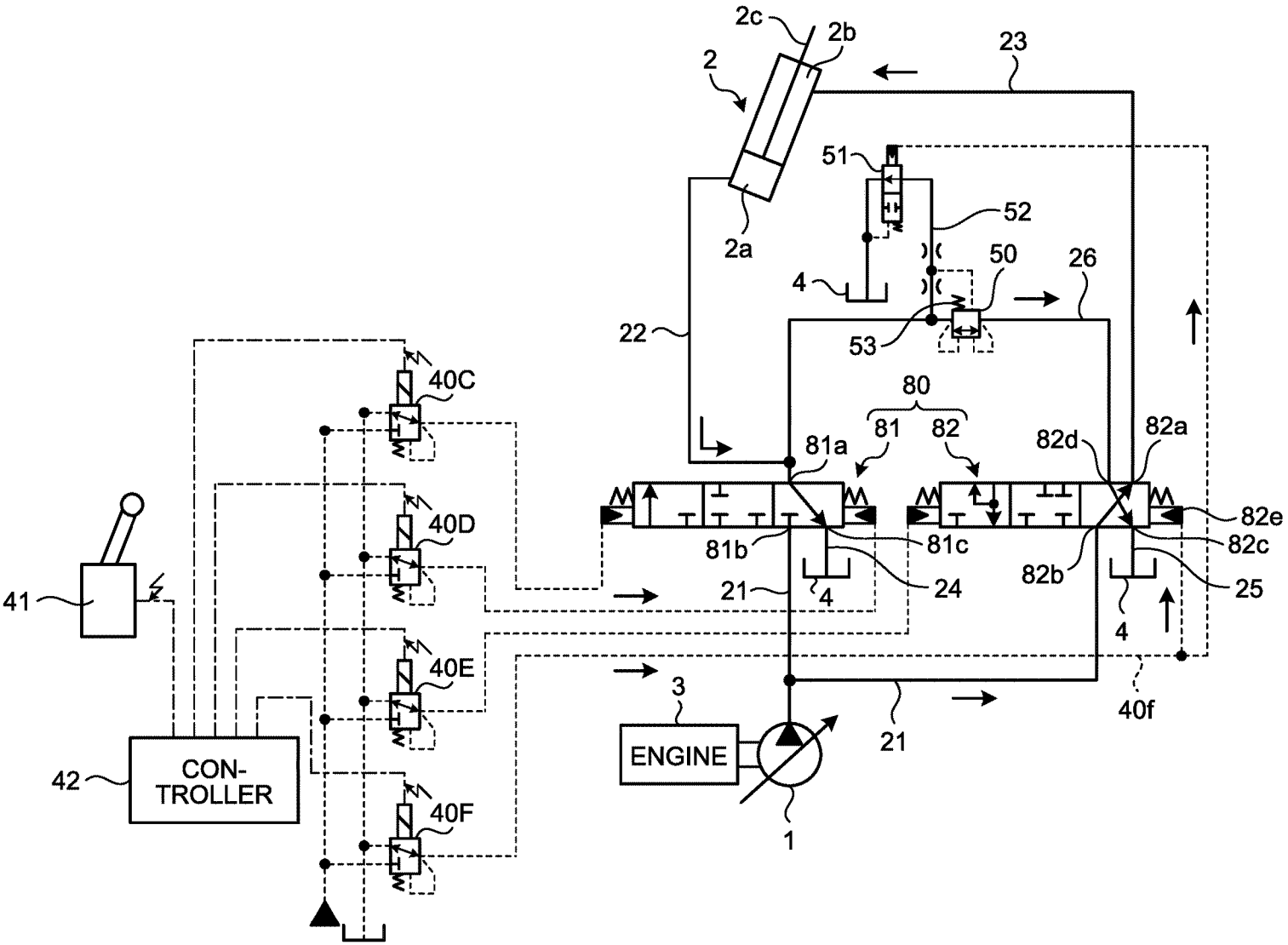
FIG. 8 illustrates a state in which each of the two spools is arranged at a contraction position in the hydraulic circuit illustrated in FIG. 7.
Figure 9:
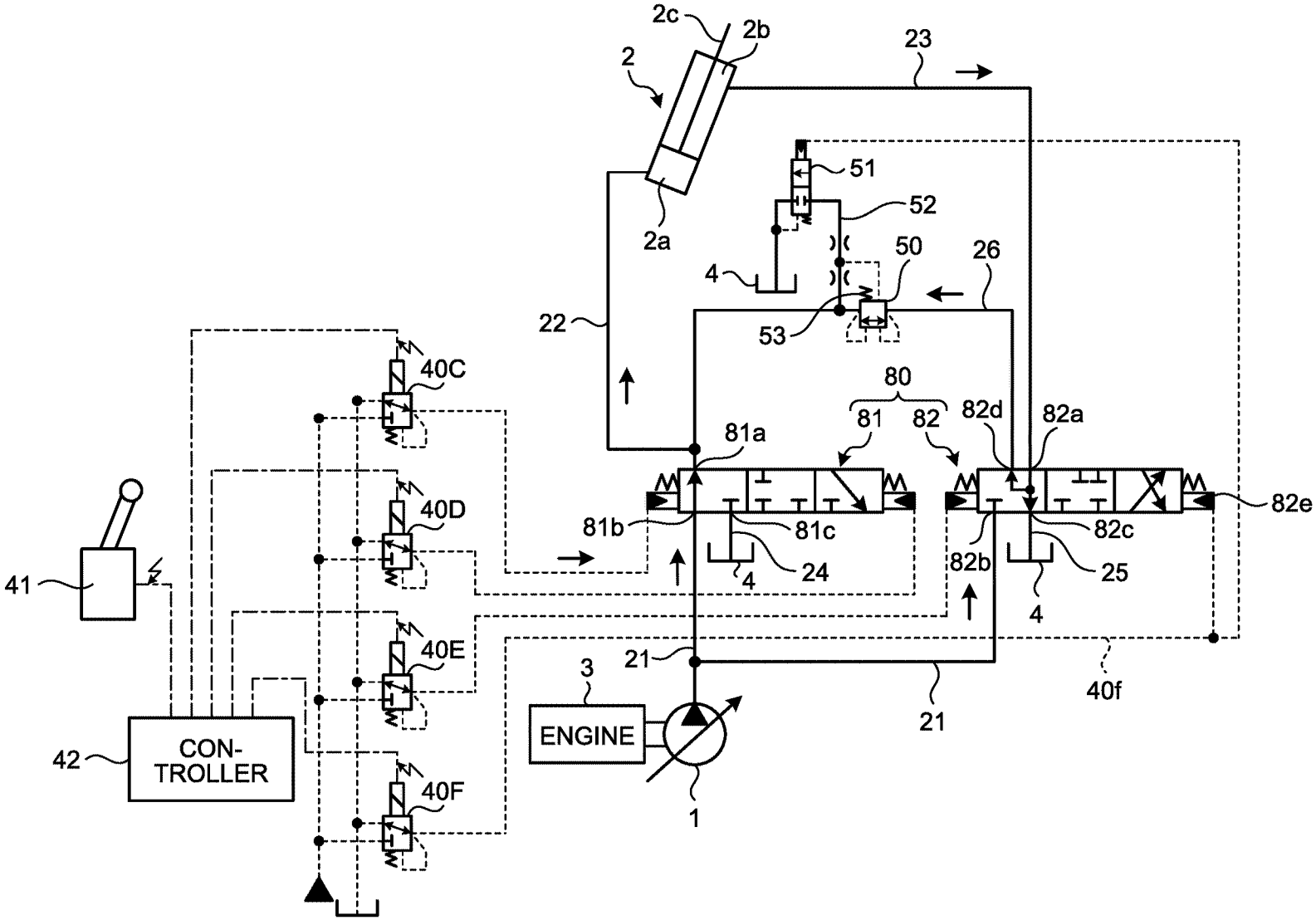
FIG. 9 illustrates a state in which each of the two spools is arranged at an expansion position in the hydraulic circuit illustrated in FIG. 7.

FIGS. 7 to 9 illustrate a hydraulic circuit according to a second embodiment of the present invention. The hydraulic circuit illustrated here is configured to operate the hydraulic cylinder 2 by means of oil supplied from the hydraulic pump 1 in a similar manner to the first embodiment and differs from the first embodiment in that a direction switching valve 80 includes two spools. Hereinafter, different components in the second embodiment from those in the first embodiment will mainly be described. Similar components to those in the first embodiment are labeled with the same reference signs, and description of the respective duplicate components is omitted.

Two spools 81 and 82 of the direction switching valve 80 are of a closed center type operated by the pilot pressure output from individual operation valves 40C, 40D, 40E, and 40F. The operation valves 40C, 40D, 40E, and 40F are operated by a control signal output from the controller 42 along with an operation of the operation lever (electric lever) 41.

The first spool 81 illustrated on the left side in FIG. 7 is configured to selectively switch connection states of a pump port 81*b* and a drain port 81*c* to one input/output port 81*a*.

More specifically, in a case in which the first spool 81 moves to the left side from a neutral position illustrated in FIG. 7 and is arranged at a contraction position illustrated in FIG. 8, the input/output port 81*a* is connected to the drain port 81*c*, and the pump port 81*b* is kept closed. In a case in which the first spool 81 moves to the right side from the neutral position and is arranged at an expansion position illustrated in FIG. 9, the input/output port 81*a* is connected to the pump port 81*b*, and the drain port 81*c* is kept closed. In the first spool 81, the bottom oil path 22 is connected to the input/output port 81*a*. The pump oil path 21 is connected to the pump port 81*b*, and the first tank oil path 24 connected to the tank 4 is connected to the drain port 81*c*.

The second spool 82 illustrated on the right side in FIG. 7 is configured to selectively switch connection states of a pump port 82*b* and a drain port 82*c* to one input/output port 82*a* and to selectively switch connection states of the input/output port 82*a* and the drain port 82*c* to one bypass port 82*d*.

More specifically, in a case in which the second spool 82 moves to the left side from a neutral position illustrated in FIG. 7 and is arranged at a contraction position illustrated in FIG. 8, the input/output port 82*a* is connected to the pump port 82*b*, and the bypass port 82*d* is kept connected to the drain port 82*c*. In a case in which the second spool 82 moves to the right side from the neutral position and is arranged at an expansion position illustrated in FIG. 9, the input/output port 82*a* is branched and connected to the drain port 82*c* and the bypass port 82*d*, and the pump port 82*b* is kept closed. In the second spool 82, the rod oil path 23 is connected to the input/output port 82*a*. The pump oil path 21 is connected to the pump port 82*b*, and the second tank oil path 25 connected to the tank 4 is connected to the drain port 82*c*. That is, in the direction switching valve 80, a total of two different tank oil paths 24 and 25 are connected to the spools 81 and 82.

Further, as illustrated in FIG. 7, the bypass oil path 26 is connected to the bypass port 82*d* of the second spool 82. The bypass oil path 26 is branched from the bottom oil path 22 and includes the pilot operation check valve 50 in the middle thereof. The pilot operation check valve 50 performs a switching operation by means of the pilot pressure output from the operation valve 40F to control a flow of oil in the bypass oil path 26. Since the pilot operation check valve 50 applied in the second embodiment has a similar configuration to that of the first embodiment, the pilot operation check valve 50 is labeled with the same reference sign, and description thereof is omitted. Meanwhile, in the second embodiment, a pilot oil path 40*f* from the aforementioned operation valve 40F is configured to cause the pilot pressure to act on a pressure chamber 82*e* provided on the right side of the second spool 82. That is, in the aforementioned hydraulic circuit, in a case in which the second spool 82 is arranged at the contraction position, the pilot pressure acts on the switching valve element 51.

In the hydraulic circuit configured as above, for example, when the operation lever 41 is operated in the state illustrated in FIG. 7 to contract the hydraulic cylinder 2, the pilot pressure is output from the operation valves 40D and 40F to the two spools 81 and 82 by a control signal from the controller 42, and the respective spools move to the left side to reach the contraction position, as illustrated in FIG. 8. Accordingly, while oil discharged from the hydraulic pump 1 is supplied via the pump oil path 21 and the rod oil path 23 to the rod chamber 2*b* of the hydraulic cylinder 2, oil is exhausted from the bottom chamber 2*a* of the hydraulic cylinder 2 via the bottom oil path 22 and the first tank oil path 24 to the tank 4. This causes the hydraulic cylinder 2 to contract.

During this period, since the pilot pressure acts on the switching valve element 51 from the operation valve 40F, the pilot operation check valve 50 provided on the bypass oil path 26 is in a state of allowing flows of oil in both directions between the bottom oil path 22 and the bypass port 82*d* of the second spool 82 of the direction switching valve 80 in the bypass oil path 26. That is, the pilot operation check valve 50 is in a state of allowing a flow of oil from the bypass port 82*d* of the direction switching valve 80 to the bottom oil path 22 and a flow of oil from the bottom oil path 22 to the bypass port 82*d*. Hence, oil exhausted from the bottom chamber 2*a* partially passes the bypass oil path 26 and is exhausted via the second tank oil path 25 connected to the drain port 82*c* of the second spool 82 to the tank 4 (quick return circuit). Accordingly, when the hydraulic cylinder 2 is contracted, the pressure of the bottom oil path 22 decreases, and it is possible to prevent a pressure loss from being generated.

Moreover, in a case in which the pressure of the bottom chamber 2*a* decreases even during the above period, the opening area of the pilot operation check valve 50 decreases to correspond to the decreased pressure of the bottom oil path 22, and a flow of oil via the bypass oil path 26 is restricted. Consequently, this hydraulic circuit may not cause a situation in which cavitation occurs in the bottom chamber 2*a* when the hydraulic cylinder 2 is contracted.

Conversely, in the hydraulic circuit, when the operation lever 41 is operated in the state illustrated in FIG. 7 to expand the hydraulic cylinder 2, the pilot pressure is output from the operation valves 40C and 40E to the two spools 81 and 82 by a control signal from the controller 42, and the respective spools 81 and 82 move to the right side to reach the expansion positions, as illustrated in FIG. 9. Accordingly, while oil discharged from the hydraulic pump 1 is supplied via the pump oil path 21 and the bottom oil path 22 to the bottom chamber 2*a* of the hydraulic cylinder 2, oil is exhausted from the rod chamber 2*b* of the hydraulic cylinder 2 via the rod oil path 23 and the second tank oil path 25 to the tank 4. This causes the hydraulic cylinder 2 to expand.

During this period, the pilot operation check valve 50 provided on the bypass oil path 26 is in a state of allowing only a flow of oil from the bypass port 82*d* to the bottom oil path 22. As a result, when the hydraulic cylinder 2 is expanded, oil supplied from the pump oil path 21 to the bottom oil path 22 does not pass the bypass oil path 26 but is reliably supplied from the bottom oil path 22 to the bottom chamber 2*a* of the hydraulic cylinder 2. Moreover, in a case in which the pressure of the bottom oil path 22 gets lower than that of the rod oil path 23, oil exhausted from the rod chamber 2*b* of the hydraulic cylinder 2 is partially supplied via the bypass oil path 26 to the bottom oil path 22. This can prevent a situation in which oil in the bottom chamber 2*a* lacks when the hydraulic cylinder 2 is expanded from being generated, and the arm 32 of the construction machine 30 can be operated quickly (regeneration circuit).

As described above, in this hydraulic circuit, by means of the operation of the second spool 82, the bypass oil path 26 is selectively connected to the rod oil path 23 and the second tank oil path 25. Thus, by providing the single pilot operation check valve 50 in the bypass oil path 26, the bypass oil path 26 can selectively function as a quick return circuit and a regeneration circuit. Consequently, it is not necessary to provide a control valve dedicated for the quick return circuit and a control valve dedicated for the regeneration circuit in the hydraulic circuit, it is possible to prevent a size increase of a hydraulic apparatus to which the hydraulic circuit is applied, and it is possible to restrict a cost increase along with an increase in the number of parts.

Moreover, in the hydraulic circuit according to the second embodiment, since the direction switching valve 80 including the two spools 81 and 82 is applied, meter-in and meter-out control to the hydraulic cylinder 2 can be performed independently. This provides favorable operability of the hydraulic cylinder 2 serving as a target for control and enables working efficiency of the construction machine 30 to which the present invention is applied to be improved.

Third Modification Example

Figure 10:
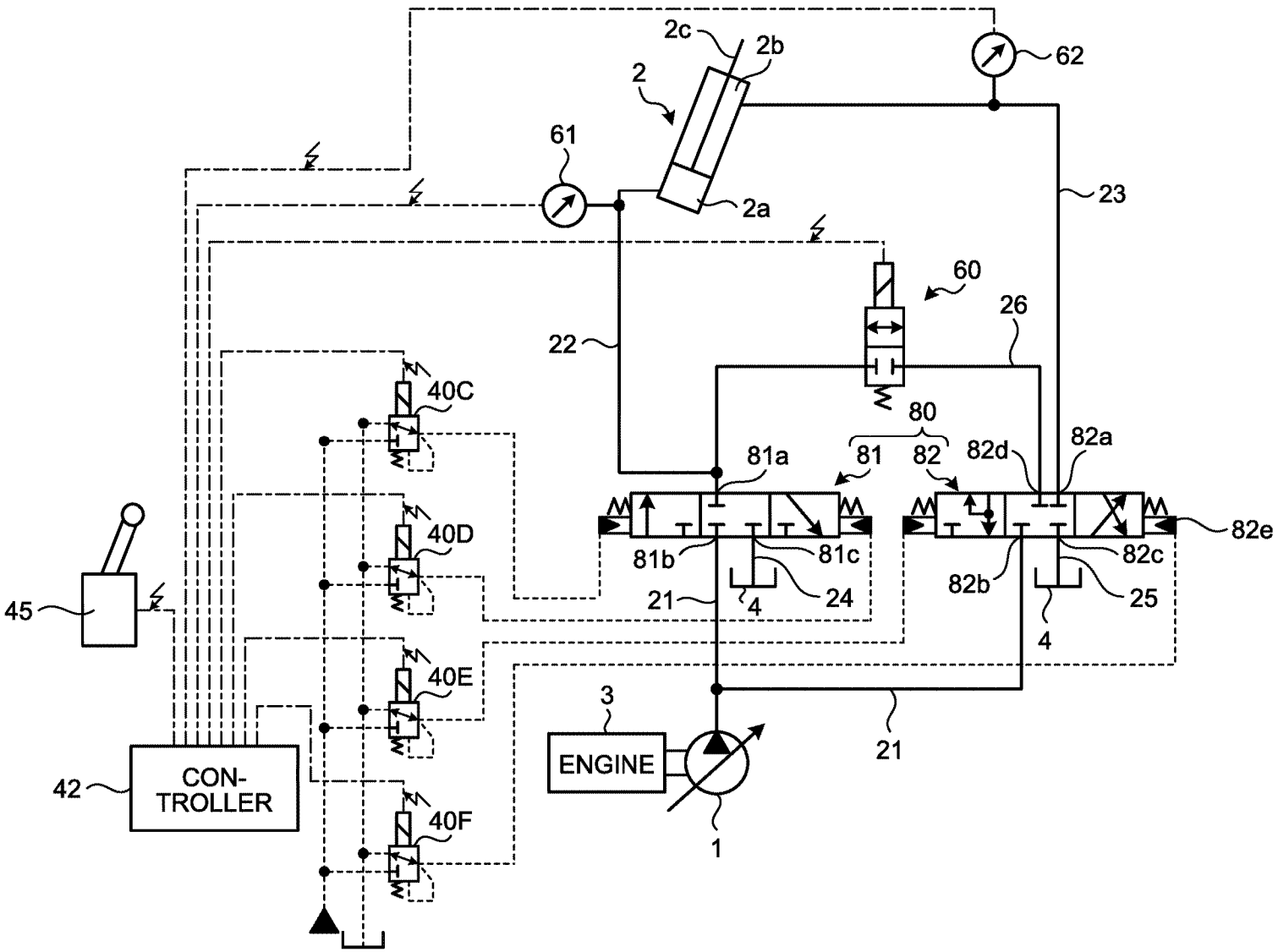
FIG. 10 illustrates a third modification example of the hydraulic circuit illustrated in FIG. 7.

Meanwhile, in the aforementioned second embodiment, although the hydraulic circuit using the pilot operation check valve 50 as a pilot operation control valve is illustrated, the pilot operation switching valve 60 switching to a connection position and a disconnection position can be used as the pilot operation control valve as in a third modification example illustrated in FIG. 10. This pilot operation switching valve 60 has a similar configuration to that in the first modification example and is similar to the first modification example in that the bottom oil path 22 and the rod oil path 23 are provided with the pressure gauges 61 and 62, respectively.

That is, in a case in which oil discharged from the hydraulic pump 1 is supplied via the pump oil path 21 and the rod oil path 23 to the rod chamber 2*b* of the hydraulic cylinder 2 to contract the hydraulic cylinder 2, a control signal is output from the controller 42 to open the pilot operation switching valve 60. As a result, oil exhausted from the bottom chamber 2*a* partially passes the bypass oil path 26 and is exhausted to the tank 4. Accordingly, when the hydraulic cylinder 2 is contracted, the pressure of the bottom oil path 22 decreases, and it is possible to prevent a pressure loss from being generated (quick return circuit). During this period, in a case in which the pressure of the bottom oil path 22 is lower than a predetermined threshold value, a control signal is preferably output from the controller 42 to decrease the opening area of the pilot operation switching valve 60 to prevent cavitation from occurring in the bottom chamber 2*a* of the hydraulic cylinder 2 in advance.

On the other hand, in a case in which oil discharged from the hydraulic pump 1 is supplied via the pump oil path 21 and the bottom oil path 22 to the bottom chamber 2*a* of the hydraulic cylinder 2 to expand the hydraulic cylinder 2, the pressure of the bottom oil path 22 and the pressure of the rod oil path 23 are compared in the controller 42. In a case in which the pressure of the bottom oil path 22 is lower than the pressure of the rod oil path 23, the controller 42 outputs a control signal to open the pilot operation switching valve 60. As a result, oil exhausted from the rod chamber 2*b* of the hydraulic cylinder 2 is partially supplied via the bypass oil path 26 to the bottom oil path 22. Accordingly, the bottom chamber 2*a* of the hydraulic cylinder 2 is supplied with oil supplied from the pump oil path 21 to the bottom oil path 22 in a state in which oil from the bypass oil path 26 is added, and the arm 32 of the construction machine 30 can be operated quickly (regeneration circuit).

Conversely, in a case in which the pressure of the bottom oil path 22 is higher than the pressure of the rod oil path 23, the controller 42 keeps the pilot operation switching valve 60 closed. Accordingly, in this hydraulic circuit, oil supplied from the hydraulic pump 1 via the pump oil path 21 to the bottom oil path 22 does not pass the bypass oil path 26 but is reliably supplied from the bottom oil path 22 to the bottom chamber 2*a* of the hydraulic cylinder 2.

Meanwhile, in the aforementioned third modification example, although the opening area of the pilot operation switching valve 60 is controlled when the hydraulic cylinder 2 is contracted based on the comparison result between the pressure of the bottom oil path 22 detected in the pressure gauge 61 and the pressure of the rod oil path 23 detected in the pressure gauge 62, the present invention is not limited to this. For example, moving speed of the rod 2*c* may be calculated from the displacement amount of the rod 2*c* detected by a stroke sensor (not illustrated) provided in the hydraulic cylinder 2, target speed of the rod 2*c* may be calculated from the operation signal of the operation lever 41, and a control signal may be output so that the opening area of the pilot operation switching valve 60 may change in accordance with the difference between these speeds. Specifically, in a case in which the actual moving speed of the rod 2*c* is higher than the target speed of the rod 2*c*, a control signal may be output from the controller 42 so that the opening area of the pilot operation switching valve 60 may decrease as the difference between these speeds is greater.

Fourth Modification Example

Figure 11:
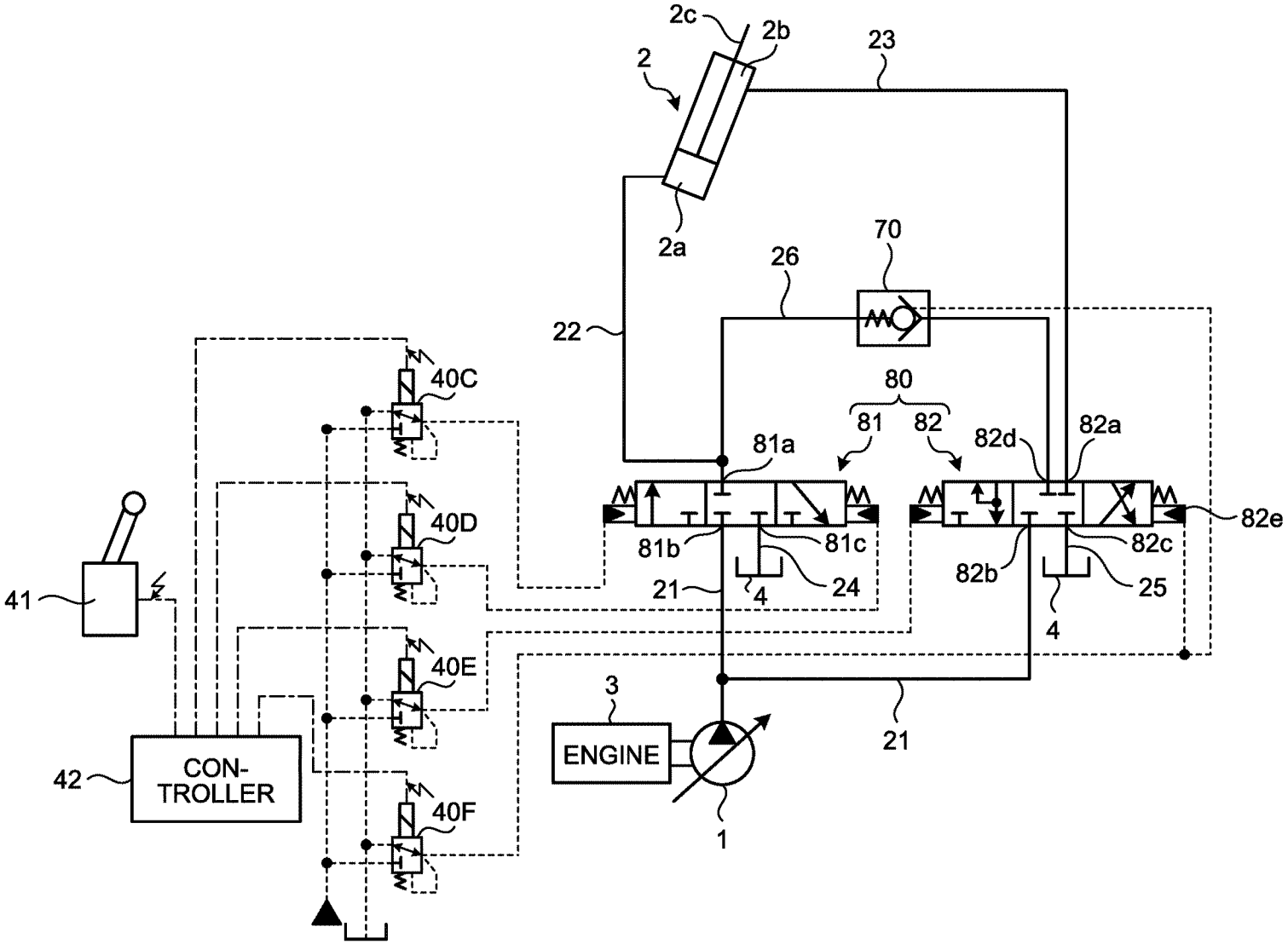
FIG. 11 illustrates a fourth modification example of the hydraulic circuit illustrated in FIG. 7.

Further, in the aforementioned second embodiment, although the pilot operation check valve 50, which is in an open state in a case in which the pressure on the upstream side is high, is applied, the pilot operation check valve 70, which allows a flow of oil from the bottom oil path 22 to the bypass port 82*d* only in a case in which a control signal is provided from the controller 42, may be applied as in a fourth modification example illustrated in FIG. 11. This pilot operation check valve 70 has a similar configuration to that in the second modification example.

That is, in the fourth modification example, in a case in which oil discharged from the hydraulic pump 1 is supplied via the pump oil path 21 and the rod oil path 23 to the rod chamber 2*b* of the hydraulic cylinder 2, a control signal is output from the controller 42 to the operation valve 40F, and the pilot pressure acts on the pilot operation check valve 70. In a case in which the pilot pressure acts on the pilot operation check valve 70, a flow of oil from the bottom oil path 22 to the bypass port 82*d* of the direction switching valve 80 is allowed in the bypass oil path 26. Thus, oil exhausted from the bottom chamber 2*a* partially passes the bypass oil path 26 and is exhausted to the tank 4. Consequently, when the hydraulic cylinder 2 is contracted, the pressure of the bottom oil path 22 decreases, and it is possible to prevent a pressure loss from being generated (quick return circuit).

On the other hand, in a case in which oil discharged from the hydraulic pump 1 is supplied via the pump oil path 21 and the bottom oil path 22 to the bottom chamber 2*a* of the hydraulic cylinder 2, no control signal is output from the controller 42 to the operation valve 40F, and no pilot pressure acts on the pilot operation check valve 70. Hence, in this case, the pilot operation check valve 70 opens only in a case in which the pressure of the bottom oil path 22 is lower than the pressure between the bypass port 82*d* and the pilot operation check valve 70. As a result, oil exhausted from the rod chamber 2*b* of the hydraulic cylinder 2 is partially supplied via the bypass oil path 26 to the bottom oil path 22, a situation in which oil in the bottom chamber 2*a* lacks can be prevented, and the arm 32 of the construction machine 30 can be operated quickly (regeneration circuit). In a case in which the pressure of the bottom oil path 22 is higher than the pressure between the bypass port 82*d* and the pilot operation check valve 70, the pilot operation check valve 70 is kept closed. Thus, oil supplied from the hydraulic pump 1 via the pump oil path 21 to the bottom oil path 22 does not pass the bypass oil path 26 but is reliably supplied to the bottom chamber 2*a* of the hydraulic cylinder 2.

Meanwhile, in the aforementioned first and second embodiments, although the hydraulic circuit configured to operate the arm 32 of the construction machine 30 is illustrated, the hydraulic circuit may be applied to another hydraulic cylinder.

Further, in the hydraulic circuit according to the aforementioned first and second embodiments, although the rod oil path 23 is connected to the second tank oil path 25 in a case in which the direction switching valve 10 or 80 is arranged at the expansion position, the rod oil path 23 may not necessarily be connected to the second tank oil path 25, and the total amount of oil exhausted from the rod chamber 2*b* may be supplied to the bottom chamber 2*a* of the hydraulic cylinder 2. For example, in the first embodiment, by closing the first drain port 11*d* and the second drain port 11*e* in a case in which the first input/output port 11*a* is connected to the pump port 11*c*, and in which the second input/output port 11*b* is connected to the bypass port 11*f*, the total amount of oil exhausted from the rod chamber 2*b* can be supplied to the bottom chamber 2*a* of the hydraulic cylinder 2. Further, in the second embodiment, by closing the pump port 82*b* and the drain port 82*c* in a case in which the input/output port 82*a* is connected to the bypass port 82*d* in the second spool 82, the total amount of oil exhausted from the rod chamber 2*b* can be supplied to the bottom chamber 2*a* of the hydraulic cylinder 2.

Further, in the aforementioned first and second embodiments, although the opening area of the pilot operation check valve 50 changes to correspond to a balance between the pressure between the direction switching valve 10 or 80 and the pilot operation check valve 50 and the pressing force of the built-in spring 53 in the bypass oil path 26 in a case in which the pilot pressure is supplied from the operation valve 40B or 40F, the present invention is not limited to this. For example, in a case in which a built-in spring having a high spring constant is used as the built-in spring 53, the pilot operation check valve 50 may be configured to switch the state of the bypass oil path 26 between two positions, a fully opened state and a fully closed state.

Still further, in the aforementioned first and second embodiments, although oil in the back pressure oil path 52 is entirely drained into the tank 4 in a case in which the pilot pressure is supplied from the operation valve 40B or 40F, the present invention is not limited to this. For example, by using a switching valve element in which the opening area changes as the switching valve element 51 and restricting the amount of oil to be drained from the back pressure oil path 52 into the tank 4 when the pilot pressure is supplied, the pressure of the bypass oil path 26 when the pilot operation check valve 50 opens may be changed even in a case in which the same built-in spring 53 is used. Meanwhile, as a way to change the pressure of the bypass oil path 26 when the pilot operation check valve 50 opens, the pilot pressure output from the operation valve 40B or 40F may directly act as the back pressure of the pilot operation check valve 50.

REFERENCE SIGNS LIST

1 HYDRAULIC PUMP
2 HYDRAULIC CYLINDER
2*a* BOTTOM CHAMBER
2*b* ROD CHAMBER
2*c* ROD
4 TANK
10 DIRECTION SWITCHING VALVE
21 PUMP OIL PATH
22 BOTTOM OIL PATH
23 ROD OIL PATH
24 FIRST TANK OIL PATH
25 SECOND TANK OIL PATH
26 BYPASS OIL PATH
41 OPERATION LEVER
42 CONTROLLER
50 PILOT OPERATION CHECK VALVE
60 PILOT OPERATION SWITCHING VALVE
70 PILOT OPERATION CHECK VALVE
80 DIRECTION SWITCHING VALVE
81 FIRST SPOOL
82 SECOND SPOOL

The invention claimed is:

1. A hydraulic circuit comprising:

a direction switching valve, disposed between a hydraulic pump and a hydraulic cylinder, configured to switch a connection state of the hydraulic pump with respect to a bottom chamber and a rod chamber of the hydraulic cylinder to expand and contract the hydraulic cylinder;

a pump oil path connecting between a discharge port of the hydraulic pump and the direction switching valve;

a bottom oil path connecting between the bottom chamber of the hydraulic cylinder and the direction switching valve;

a rod oil path connecting between the rod chamber of the hydraulic cylinder and the direction switching valve;

two tank oil paths each connecting between a tank and the direction switching valve; and a bypass oil path connecting between the bottom oil path and the direction switching valve and including a pilot operation control valve in a middle of the bypass oil path, wherein the direction switching valve is in a state in which the bottom oil path is connected to a first one of the two tank oil paths and in which the bypass oil path is connected to a second one of the two tank oil paths in a case in which the pump oil path is connected to the rod oil path and is in a state in which the rod oil path is connected to the bypass oil path in a case in which the pump oil path is connected to the bottom oil path, and wherein the pilot operation control valve is in a state of allowing flows of oil in both directions between the direction switching valve and the bottom oil path in the bottom oil path in a case in which the pump oil path is connected to the rod oil path by the direction switching valve and is in a state of allowing only a flow of oil from the direction switching valve to the bottom oil path in the bottom oil path in a case in which the pump oil path is connected to the bottom oil path by the direction switching valve.

2. The hydraulic circuit according to claim 1, wherein the direction switching valve includes a first spool disposed between the bottom chamber of the hydraulic cylinder and the hydraulic pump and a second spool disposed between the rod chamber of the hydraulic cylinder and the hydraulic pump, wherein, in a case in which the second spool causes the pump oil path to be connected to the rod oil path, the first spool causes the bottom oil path to be connected to the first one of the two tank oil paths and causes the bypass oil path to be connected to the second one of the two tank oil paths, and wherein, in a case in which the first spool causes the pump oil path to be connected to the bottom oil path, the second spool causes the rod oil path to be connected to the bypass oil path.

3. The hydraulic circuit according to claim 1, wherein, in a case in which the pump oil path is connected to the bottom oil path, the direction switching valve causes the rod oil path to be connected to at least one of the two tank oil paths.

4. The hydraulic circuit according to claim 1, wherein the pilot operation control valve is formed by a pilot operation check valve.

5. The hydraulic circuit according to claim 1, wherein the pilot operation control valve is formed by a pilot operation switching valve.

6. The hydraulic circuit according to claim 1, wherein, in a case in which the pump oil path is connected to the rod oil path by the direction switching valve, an opening area of the pilot operation control valve decreases as a pressure of the bottom oil path decreases.

7. The hydraulic circuit according to claim 1, further comprising a controller configured to operate the direction switching valve in accordance with an operation of an operation lever and output a control signal to the pilot operation control valve, wherein, in a case in which the pump oil path is connected to the rod oil path by the direction switching valve, the controller calculates target speed of a rod based on an operation signal of the operation lever and calculates actual moving speed of the rod based on a stroke amount of the rod, and in a case in which the actual moving speed of the rod is higher than the target speed, the controller outputs a control signal so that the opening area of the pilot operation control valve decreases as a difference between the target speed and the actual moving speed increases.

* * * * *